US008902032B2

(12) United States Patent
Moiseev et al.

(10) Patent No.: US 8,902,032 B2
(45) Date of Patent: Dec. 2, 2014

(54) INDUCTION DEVICE

(71) Applicant: Kabushiki Kaisha Toyota Jidoshokki, Aichi-ken (JP)

(72) Inventors: Sergey Moiseev, Aichi-ken (JP); Yasuhiro Koike, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 127 days.

(21) Appl. No.: 13/651,697

(22) Filed: Oct. 15, 2012

(65) Prior Publication Data

US 2013/0093553 A1 Apr. 18, 2013

(30) Foreign Application Priority Data

Oct. 18, 2011 (JP) ..... 2011-229129

(51) Int. Cl.
*H01F 27/08* (2006.01)

(52) U.S. Cl.
USPC ..... 336/55

(58) Field of Classification Search
USPC ..... 336/55–62, 65, 83, 200, 212, 232
See application file for complete search history.

(56) References Cited

U.S. PATENT DOCUMENTS

| | | | |
|---|---|---|---|
| 1,805,534 | A | 5/1931 | Troy |
| 5,285,761 | A | 2/1994 | Hancock et al. |
| 6,002,318 | A | 12/1999 | Werner et al. |
| 6,980,077 | B1 | 12/2005 | Chandrasekaran et al. |
| 2007/0261231 | A1 | 11/2007 | Bosley et al. |
| 2011/0121935 | A1 | 5/2011 | Chu et al. |
| 2012/0161911 | A1 | 6/2012 | Moiseev et al. |
| 2012/0200382 | A1 | 8/2012 | Hejny |
| 2012/0293290 | A1* | 11/2012 | Kido et al. ..... 336/60 |

FOREIGN PATENT DOCUMENTS

| | | |
|---|---|---|
| DE | 3307776 | 9/1984 |
| DE | 19637211 | 4/1998 |
| DE | 19808592 | 12/1998 |
| DE | 19954682 | 8/2001 |
| DE | 10164090 | 8/2002 |
| EP | 2463869 | 6/2012 |
| JP | 62-186412 | 11/1987 |
| JP | 2-95222 | 7/1990 |
| JP | 2-170510 | 7/1990 |
| JP | 2001-15350 | 1/2001 |

(Continued)

OTHER PUBLICATIONS

Germany Office action, mail date is Apr. 17, 2013.

(Continued)

*Primary Examiner* — Tuyen Nugyen
(74) *Attorney, Agent, or Firm* — Greenblum & Bernstein, P.L.C.

(57) ABSTRACT

An induction device includes a first core made of a ferrite material, a second core made of a material having a lower magnetic permeability than the ferrite material and a higher saturation magnetic flux density than the ferrite material, a cooling device and a coil. The first core and the second core cooperate to form a closed magnetic circuit. The first core includes a contact surface cooled by the cooling device and a first magnetic leg extending so as to intersect with the contact surface and toward the second core. The second core includes a second magnetic leg extending so as to intersect with the contact surface and toward the first core and disposed to be wound around by the coil.

9 Claims, 4 Drawing Sheets

(56) References Cited

FOREIGN PATENT DOCUMENTS

| | | |
|---|---|---|
| JP | 2002-57050 | 2/2002 |
| JP | 2002-208521 | 7/2002 |
| JP | 2006-13067 | 1/2006 |
| JP | 2007-35690 | 2/2007 |
| JP | 2007-88340 | 4/2007 |
| JP | 2008-218699 | 9/2008 |
| JP | 2009-88250 | 4/2009 |
| JP | 2009-278025 | 11/2009 |

OTHER PUBLICATIONS

Japan Office action, mail date is Aug. 6, 2013.

* cited by examiner

INDUCTION DEVICE

BACKGROUND OF THE INVENTION

The present invention relates to an induction device.

Generally, a ferrite core and a dust core are used for an induction device such as a reactor and a transformer. In the case of a ferrite core, the DC superposition characteristic can be ensured by providing an air gap between the cores. However, the provision of the air gap invites an increased loss of magnetic flux. In the case of a dust core, on the other hand, the number of winding turns of a coil need be increased due to a low magnetic permeability of a powder for the dust core, so that copper loss tends to be increased. Japanese Patent Application Publication 2009-278025 discloses a thin choke coil as an induction device that is made of a ferrite core and a dust core to solve the above problem.

The induction device disclosed by the Publication includes a rectangular frame-like ferrite core and an I type dust core having a coil wound therearound and inserted in the ferrite core. The induction device of such structure ensures the DC superposition characteristic without providing any air gap between the cores and prevents an increase in the number of winding turns of a coil.

In a composite magnetic core including a ferrite core and a dust core, the saturation magnetic flux density of the ferrite core changes depending on the temperature, so that the ferrite core should preferably be cooled by fixing the ferrite core to a radiator.

The choke coil of the Publication may be cooled by mounting a cooling radiator to the choke coil. For this purpose, the ferrite core of the choke coil may be formed so as to eliminate the opening on the side of the ferrite core that is opposite from the side where dust core is inserted and a radiator may be mounted to the side of the ferrite core where the opening is eliminated. For cooling the coil as well as the dust core, however, an additional radiator need be mounted to the choke coil on the dust core side thereof. The provision of the additional radiator makes the structure of the choke coil complicated.

If the radiator is fixed to a side surface of the ferrite core, end surface of the coil can be cooled from the side surface of the ferrite core by the radiator. In the above choke coil, the dust core having a coil wound therearound need be assembled to the ferrite core from a lateral side of the ferrite core. However, this manner of assembling is troublesome.

The present invention is directed to providing an induction device having a first core and a second core wound therearound with a coil, wherein the first core and the coil can be cooled from the same direction and the manufacturing can be performed easily.

SUMMARY OF THE INVENTION

An induction device includes a first core made of a ferrite material, a second core made of a material having a lower magnetic permeability than the ferrite material and a higher saturation magnetic flux density than the ferrite material, a cooling device and a coil. The first core and the second core cooperate to form a closed magnetic circuit. The first core includes a contact surface cooled by the cooling device and a first magnetic leg extending so as to intersect with the contact surface and toward the second core. The second core includes a second magnetic leg extending so as to intersect with the contact surface and toward the first core and disposed to be wound around by the coil.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1A:
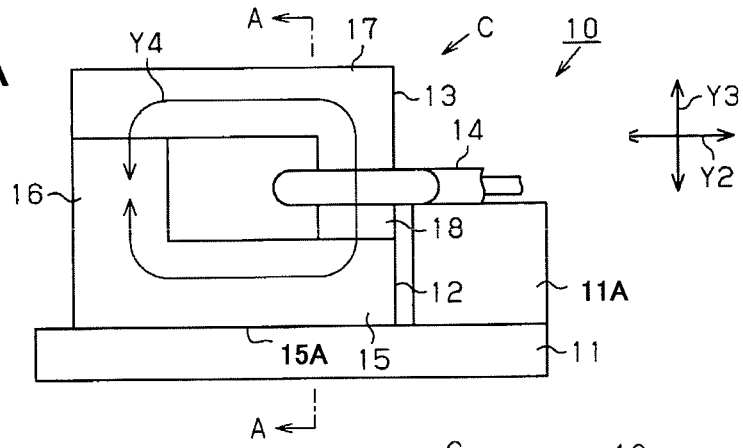
FIG. 1A is a schematic front view of a reactor according to an embodiment of the present invention.
Figure 1B:
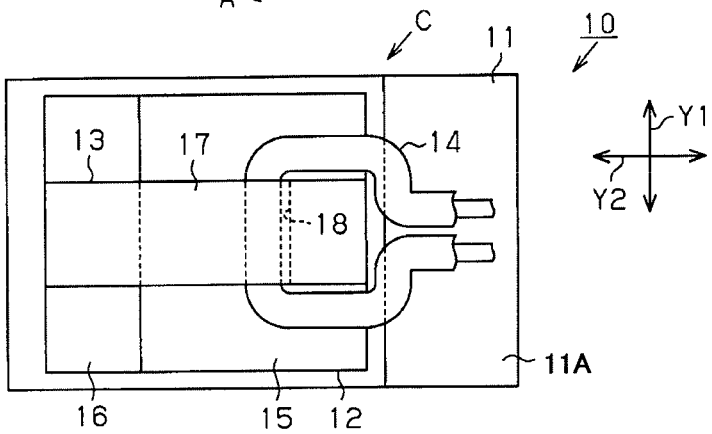
FIG. 1B is a schematic plan view of the reactor of FIG. 1A.
Figure 1C:
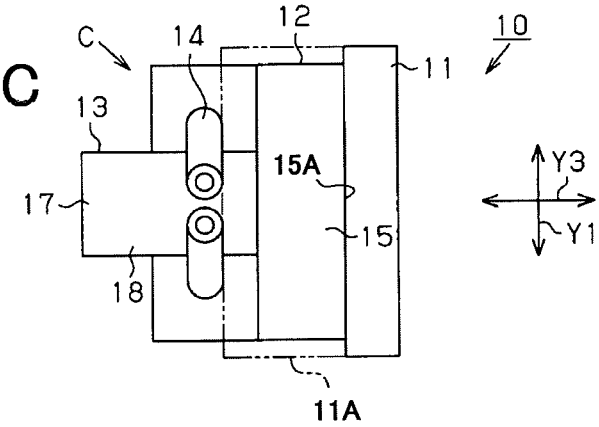
FIG. 1C is a schematic right side view of the reactor of FIG. 1A.

The following will describe the reactor as the induction device according to the embodiment of the present invention with reference to FIGS. 1A through 1C. The reactor is generally designated by numeral 10 and includes a radiator plate 11 as the cooling device which is made of an aluminum alloy. For the sake of convenience of the description, the double-headed arrows Y1 in FIGS. 1B and 1C represent the width direction of the reactor 10, the double-headed arrows Y2 in FIGS. 1A and 1B represent the longitudinal direction of the reactor 10 and the double-head arrows Y3 in FIGS. 1A and 1C represent the vertical direction of the reactor 10, respectively.

The reactor 10 further includes a first L type core 12 as the first core that is fixed to the radiator plate 11 at the upper surface thereof, a second L type core 13 as the second core that is fixedly mounted to the first L type core 12 at the upper surfaces thereof and a coil 14 that is wound around the second L type core 13. The first L type core 12 and the second L type core 13 cooperate to form a magnetic core C.

The first L type core 12 is made of a ferrite material such as Mn—Zn ferrite or Ni—Mn ferrite. The first L type core 12 includes a plate portion 15 that is rectangular-shaped and extends in the longitudinal direction Y2 as shown in FIG. 1B. Lower surface of the plate portion 15 (of the first L type core 12) serves as a contact surface 15A that is in contact with the radiator plate 11.

The first L type core 12 further includes a wall portion 16 that is formed integrally with the plate portion 15 at the left end thereof as seen in FIGS. 1A and 1B and extends perpendicularly to the contact surface 15A (or to the radiator plate 11) and toward the second L type core 13 (or upward), so that the first L type core 12 is L-shaped as seen in the front view of FIG. 1A. The wall portion 16 serves as the first magnetic leg of the first L type core 12 as the first core of the present invention. The wall portion 16 is formed extending along the entire width of the plate portion 15 as shown in FIG. 1B.

The second L type core 13 is of a dust material such as Fe—Al—Si dust, formed by pressure molding and covered with an insulating resin. The dust material of the second L type core 13 has a lower magnetic permeability and a higher saturation magnetic flux density than the ferrite material of the first L type core 12.

The second L type core 13 is rectangular-shaped in plan view as shown in FIG. 1B and includes a plate portion 17 that is disposed parallel to the plate portion 15 of the first L type core 12. The lower surface of the plate portion 17 of the second L type core 13 is in contact at the left end thereof (as seen in FIG. 1A) with the upper surface of the wall portion 16 of the first L type core 12.

The second L type core 13 further includes a leg portion 18 in the form of a square pillar that extends from right end of the lower surface of the plate portion 17 toward (or downward) and perpendicularly to the first L type core 12 (or the contact surface 15A), so that the second L type core 13 is L-shaped as seen in the front view of FIG. 1B. The leg portion 18 serves as the second magnetic leg of the second L type core 13 as the second core of the present invention.

The lower surface of the leg portion 18 of the second L type core 13 is in contact with the upper surface (facing the second L type core 13) of the plate portion 15 of the first L type core 12 at right end thereof. The leg portion 18 is parallel to the wall portion 16 of the first L type core 12.

Figure 2:
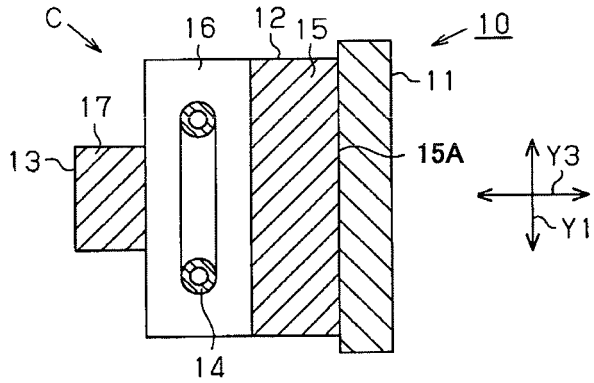
FIG. 2 is a schematic cross-sectional view of the reactor taken along the line A-A in FIG. 1A.

Referring to FIG. 2 showing a cross-sectional view taken along the line A-A in FIG. 1A, the plate portion 17 of the second L type core 13 is formed so that the area of its transverse section (indicated by shading) is smaller than that of the plate portion 15 of the first L type core 12 (also indicated by shading) and also the area of a section of the wall portion 16 of the first L type core 12 as taken perpendicularly to the vertical direction Y3 thereof. The leg portion 18 of the second L type core 13 is formed so that the area of its section as taken perpendicularly to the vertical direction Y3 thereof is smaller than that of the transverse section of the plate portion 15 of the first L type core 12 and also that of the section of the wall portion 16 of the first L type core 12 as taken perpendicularly to the vertical direction Y3 thereof.

As shown in FIGS. 1A, 1B and 1C, the second L type core 13 is disposed in the center of the first L type core 12 in the width direction Y1 thereof and extends in the longitudinal direction Y2. The first L type core 12 and the second L type core 13 cooperate to form the magnetic core C in the shape of a rectangular frame (circularity) in the front view thereof, as shown in FIG. 1A. Though the first L type core 12 is fixed to the radiator plate 11 in contact therewith, the second L type core 13 is spaced from the radiator plate 11 without being in contact therewith.

The leg portion 18 of the second L type core 13 is wound therearound with the coil 14 that is made of a copper wire covered with an insulating resin such as polyvinyl chloride. In other words, the second L type core 13 is fixed to the first L type core 12 with the leg portion 18 passed through the coil 14. A coil support member 11A is mounted to the radiator plate 11 so as to be included in the radiator plate 11, extend from the upper surface thereof toward the coil 14 (or upward) and be thermally connected to the radiator plate 11. The coil 14 is fixed to the coil support member 11A in contact with the upper surface thereof so as to be prevented from being displaced. In the embodiment, the coil 14 is wound for one turn. In the present embodiment wherein the coil 14 is wound around the leg portion 18 of the second L type core 13, the second L type core 13 is prevented from being displaced in a horizontal direction that is perpendicular to the extending direction of the leg portion 18.

The energization of the coil 14 causes the reactor 10 to form a closed magnetic circuit in such a way that magnetic flux flows from and returns to the leg portion 18 through the plate portion 17, the wall portion 16 and the plate portion 15 in this order or in reverse order. In other words, the first L type core 12 and the second L type core 13 cooperate to form a closed magnetic circuit and each of the wall portion 16 of the first L type core 12 and the leg portion 18 of the second L type core 13 serves as a single magnetic leg that forms a magnetic path with the second L type core 13 and the first L type core 12, respectively.

In the embodiment, the closed magnetic circuit includes a first magnetic path formed through the first L type core 12 and a second magnetic path formed through the second L type core 13. The length of the second magnetic path should preferably be less than 50% of the entire length of the closed magnetic circuit of the magnetic core C. Any cross-sectional area of the plate portion 17 and the leg portion 18 of the second L type core 13 as taken perpendicularly to the direction of the magnetic flux in the closed magnetic circuit is smaller than the cross-sectional area of the plate portion 15 and the wall portion 16 of the first L type core 12 as taken perpendicularly to the direction of magnetic flux in the closed magnetic circuit.

The following will describe the manufacturing or assembling method of the reactor 10 with reference to FIGS. 1A, 1B and 1C. Firstly, the first L type core 12 is mounted to the radiator plate 11 from above and fixed thereto in contact therewith. The coil 14 is disposed above the plate portion 15 of the first L type core 12 (or the radiator plate 11) and fixed to the coil support member 11A of the radiator plate 11 so that the leg portion 18 of the second L type core 13 can be passed through the coil 14 when the second L type core 13 is disposed on the first L type core 12 and also that a part of the bottom surface of the coil 14 is in contact with the upper surface of the coil support member 11A of the radiator plate 11.

Next, the second L type core 13 is mounted to the first L type core 12 from above at such a position that the leg portion 18 of the second L type core 13 is passed through the coil 14. Thus, the reactor 10 is completely assembled. In the embodiment, the first L type core 12, the coil 14 and the second L type core 13 are mounted in this order from above. In other words, assembling of the above components can be performed from one direction relative to the radiator plate 11, i.e. the respective components are assembled from above.

The following will describe the operation of the reactor 10. The energization of the coil 14 causes the coil 14, the first L type core 12 and the second L type core 13 to generate magnetic flux thereby to generate heat. The heat generated by the coil 14 is transmitted through the coil support member 11A to the radiator plate 11 and released therefrom. The coil 14 is thermally connected to the coil support member 11A and hence to the radiator plate 11 and cooled by the radiator plate 11 through the coil support member 11A.

The heat generated by the first L type core 12 is transmitted through the contact surface 15A to the radiator plate 11 and released therefrom. Specifically, the first L type core 12 and the radiator plate 11 are thermally connected through the contact surface 15A, so that the first L type core 12 is cooled by the radiator plate 11. Therefore, the contact surface 15A serves as the cooling surface that is cooled by the radiator plate 11.

The heat generated by the second L type core 13 is transmitted through the first L type core 12 to the radiator plate 11 and released therefrom. Specifically, the second L type core 13 and the radiator plate 11 are thermally connected through the first L type core 12, so that the second L type core 13 is cooled by the radiator plate 11. In the present embodiment, therefore, the first L type core 12 and the coil 14 can be cooled from the same side, i.e. the first L type core 12 (or the radiator plate 11) side, easily.

The embodiment of the present invention offers the following advantageous effects.

(1) In the embodiment, the wall portion 16 of the first L type core 12 is formed to extend perpendicularly to the contact surface 15A thereof serving as the cooling surface and also toward the second L type core 13. Meanwhile, the leg portion 18 of the second L type core 13 is formed to extend perpendicularly to the contact surface 15A of the first L type core 12 and also toward the first L type core 12. Therefore, the second L type core 13 can be assembled to the first L type core 12 by mounting from above, i.e. from the second L type core 13 side toward the first L type core 12 side. The coil 14 is disposed to be wound around the leg portion 18 of the second L type core 13 that extends perpendicularly to the contact surface 15A of the first L type core 12 and also toward the first L type core 12, so that the coil 14 can be disposed easily above the radiator plate 11 (or above the first L type core 12). Thus, the first L type core 12 and the coil 14 that is disposed to be wound around the second L type core 13 can be cooled easily from the same side, i.e. from the radiator plate 11 side, and also the reactor 10 can be manufactured easily.

(2) The leg portion 18 of the second L type core 13 is disposed to be wound around by the coil 14. The leg portion 18 of the second L type core 13 is formed so that the cross-sectional area thereof as taken perpendicularly to the flowing direction of magnetic flux in the closed magnetic circuit is smaller than that of the first L type core 12. Therefore, the length of winding wire of the coil 14 of a given number of turns can be decreased. The second L type core 13 is made of a dust material whose saturation magnetic flux density is larger than a ferrite material, so that the saturation of the magnetic flux at the leg portion 18 can be restricted.

(3) Each of the first L type core 12 and the second L type core 13 is of an L type core having a single magnetic leg. Therefore, the structure of the respective cores are simple, so that manufacturing of the core can be facilitated.

(4) The second L type core 13 is prevented from being displaced in a direction perpendicular to the extending direction of the leg portion 18 by the coil 14. Therefore, the movement of the second L type core 13 can be prevented without providing any additional restriction member.

(5) The first L type core 12 which is made of a ferrite material and fixed to the radiator plate 11 directly can be cooled by the radiator plate 11 effectively, so that a change of the saturation magnetic flux density can be restricted.

(6) The first L type core 12 made of a ferrite material and the second L type core 13 made of a dust material cooperate to form the magnetic core C. In the embodiment wherein an L type core is used for the second core, the length of the magnetic path of the second L type core 13 can be made smaller and, therefore, the inductance can be improved as compared with a case wherein a U type core is used for the second core in place of an L type core. Meanwhile, in the embodiment wherein an L type core is used for the first core, the length of the magnetic path of the first L type core 12 is increased as compared with a case wherein an I type core is used for the first core in place of an L type core. However, the first L type core 12 made of a ferrite material having a higher magnetic permeability than a dust material for the second L type core 13 restricts a decrease in the inductance of the reactor 10. Therefore, the reactor 10 according to the present embodiment has an improved inductance ensuring ease of assembling and cooling of the reactor 10.

(7) Generally, the dust material is more expensive than the ferrite material. In the embodiment wherein the second L type core 13 made of a dust material is formed as an L type core, the usage of the dust material for the second core is less as compared with a case wherein a U type core is used for the second core, with the result that the cost can be reduced.

(8) In the embodiment wherein the first L type core 12 fixed to the radiator plate 11 is of an L type and the coil 14 is disposed above the plate portion 15 of the first L type core 12, the degree of freedom of disposing the coil 14 above the first core is greater than in a case wherein an E type core is used for the first core, thus facilitating the mounting of the coil 14. Furthermore, the second L type core 13 which has the leg portion 18 and is mounted after the coil 14 is disposed can be mounted easily. In a reactor having an I type core for the first core, the degree of freedom of disposing the coil 14 can be increased further and the ease of assembling the coil 14 can be improved further than in a case wherein an L type core is used for the first core. However, the use of an I type core for the first core causes the length of magnetic path of the second L type core 13 relative to entire length of magnetic circuit to be increased thereby decreasing the magnetic permeability, so that the cross-sectional area of the second L type core 13 need be increased for increasing the magnetic permeability. Accordingly, the winding wire of the coil 14 need be made longer. In the embodiment, the first L type core 12 and the second L type core 13 are both made of an L type core, so that the above problem can be resolved appropriately.

The present invention is not limited to the above-described embodiment but may be practiced in various ways as exemplified below.

Figure 3:
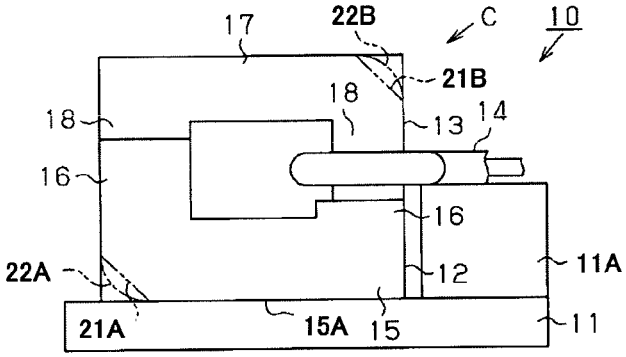
FIG. 3 is a schematic front view of a reactor according to an alternative embodiment of the present invention.

As indicated by chain double-dashed line in FIG. 3, the first L type core 12 may be formed at the bottom edge of the wall portion 16 thereof with a beveled surface 21A or a rounded surface 22A that extends along the entire width of the first L type core 12. Similarly, a beveled surface 21B or a rounded surface 22B may be formed at the top edge of the leg portion 18 of the second L type core 13 so as to extend along the entire width thereof.

As shown in FIG. 3, the first L type core 12 and the second L type core 13 may be modified into cores of a U type having a pair of wall portions 16 and a pair of leg portions 18, respectively, at the opposite ends thereof in the longitudinal direction Y2. As a further modification, either one of the U type cores may be replaced by an L type core. However, the reactor 10 according to the embodiment of FIGS. 1A, 1B, 1C and 2 is advantageous in terms of the ease of manufacturing of the reactor 10.

Figure 4:
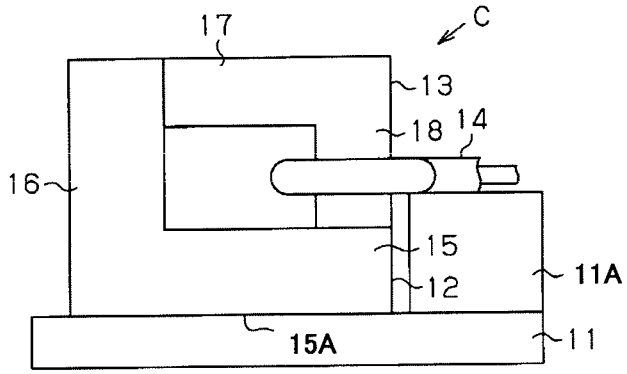
FIG. 4 is a schematic front view of a reactor according to another alternative embodiment of the present invention.

As shown in FIG. 4, the first L type core 12 and the second L type core 13 may be modified in such a way that the left end of the plate portion 17 of the second L type core 13 (as seen in the drawing) is joined to the right side surface of the upper end of the wall portion 16 of the first L type core 12. In other words, the left end of the plate portion 17 and the bottom end of the leg portion 18 of the second L type core 13 are joined in contact with the first L type core 12. However, the reactor 10 according to the embodiment of FIGS. 1A, 1B, 1C and 2 is advantageous in terms of the stability in the assembling of the reactor 10.

The reactor 10 may be arranged in such a way that the left side surface of the lower end of the leg portion 18 of the second L type core 13 is in contact with right end surface of the plate portion 15 of the first L type core 12. In other words, the left end of the plate portion 17 and the left side surface of the lower end of the leg portion 18 of the second L type core 13 are joined in contact with the first L type core 12. However, the reactor 10 according to the embodiment of FIGS. 1A, 1B, 1C and 2 is advantageous in view of the stability in the assembling of the reactor 10.

The wall portion 16 of the first L type core 12 need not extend perpendicularly to the contact surface 15A thereof or to the radiator plate 11. Specifically, the reactor 10 may be formed in such a way that the wall portion 16 of the first L type core 12 is inclined relative to the contact surface 15A. The wall portion 16 may be formed so as to intersect with the contact surface 15A and inclined toward the second L type core 13.

The leg portion 18 of the second L type core 13 need not extend perpendicularly to the plate portion 17 of the second L type core 13 or to the radiator plate 11. Specifically, the reactor 10 may be formed in such a way that the leg portion 18 is inclined relative to the contact surface 15A. The leg portion 18 may be formed so as to intersect with the contact surface 15A and inclined toward the first L type core 12.

The number of winding turns of the coil 14 may be more than one. The coil 14 may be of a planar coil and fixed to a circuit board by soldering. In this case, a member made of an insulating material may be provided between the coil 14 and the leg portion 18 of the second L type core 13 so as to prevent the second L type core 13 from being displaced.

The second L type core 13 may not be prevented from being displaced by the coil 14. In this case, the second L type core 13 should preferably be fixed by any holder that urges the second L type core 13 toward the first L type core 12.

A plurality of reactors such as 10 may be disposed on a radiator plate such as 11 thereby to make an electric device such as induction device. In making an induction device having a predetermined number of (at least two) reactors 10, firstly the predetermined number of first L type cores such as 12 are joined to the radiator plate 11. Next, a single circuit board having mounted thereon the predetermined number of coils such as 14 is disposed on the plate portion 15 of the first L type core 12 so that the coils 14 are located for their corresponding first L type cores 12. Then, second L type cores such as 13 are disposed so that the leg portions 18 of the second L type cores 13 are passed through the respective coils 14, with the result that the respective reactors 10 are completed. In the above induction device, the coils 14 can be mounted on the single circuit board easily and a plurality of the reactors 10 can be formed efficiently, as compared with a case wherein an E type core is used for the first L type core 12 and fixed to the radiator plate 11. A part of or all of the plurality of reactors may serve as the transformer having the plurality of coils 14.

The first L type core 12 may be cooled by any cooling device other than the radiator plate 11. For example, a casing that houses therein the reactor 10 with the first L type core 12 mounted in contact with the casing may serve as the cooling device. Alternatively, the first L type core 12 may be cooled by blowing refrigerant against the core.

The second L type core 13 may be made of powder of metallic glass coated on the surface thereof with insulating resin and formed into the desired core shape by pressure molding.

The wall portion 16 of the first L type core 12 and the leg portion 18 of the second L type core 13 may be formed with cross section of a circular shape or any other suitable shape. Similarly, the plate portion 15 of the first L type core 12 and the plate portion 17 of the second L type core 13 may be formed with cross section of a hexagonal shape or any other suitable shape.

A magnetic paste or a magnetic sheet may be provided between the wall portion 16 of the first L type core 12 and the second L type core 13 or between the leg portion 18 of the second L type core 13 and the first L type core 12. In other words, any suitable member may be interposed without allowing the first and the second cores to be in direct contact therewith.

The present invention is applicable to a transformer as an induction device having a plurality of coils 14.

What is claimed is:

1. An induction device, comprising:

a first core made of a ferrite material;

a second core made of a material having a lower magnetic permeability than the ferrite material and a higher saturation magnetic flux density than the ferrite material, wherein the first core and the second core cooperate to form a closed magnetic circuit, a cooling device; and a coil, wherein the first core includes:

a contact surface cooled by the cooling device; and a first magnetic leg extending to intersect with the contact surface and toward the second core, wherein the second core includes:

a second magnetic leg extending to intersect with the contact surface and toward the first core and configured to be wound around by the coil.

2. The induction device according to claim 1, wherein any cross-sectional area of the first magnetic leg of the first core perpendicular to a direction of magnetic flux in the closed magnetic circuit is larger than any cross-sectional area of the second magnetic leg of the second core perpendicular to the direction of magnetic flux in the closed magnetic circuit.

3. The induction device according to claim 1, wherein each of the first core and the second core is an L type core having a single magnetic leg.

4. The induction device according to claim 1, wherein the second core is prevented from being displaced in a direction perpendicular to an extending direction of the second magnetic leg by the coil.

5. The induction device according to claim 1, wherein the closed magnetic circuit includes a first magnetic path formed through the first core and a second magnetic path formed through the second core, wherein a length of the second magnetic path is less than 50% of an entire length of the closed magnetic circuit.

6. The induction device according to claim 1, wherein the cooling device includes a coil support member extending toward the coil and thermally connected with the coil.

7. The induction device according to claim 1, wherein an end of the first magnetic leg is in contact with the second core and an end of the second magnetic leg is in contact with the first core.

8. The induction device according to claim 1, wherein the second core is configured such that the second magnetic leg of the second core passes through the coil.

9. The induction device according to claim 1, wherein the contact surface of the first core is in contact with the cooling device.

* * * * *